US010140937B2

(12) United States Patent
Jung

(10) Patent No.: US 10,140,937 B2
(45) Date of Patent: Nov. 27, 2018

(54) DISPLAY PANEL, LIQUID CRYSTAL DISPLAY AND DRIVING METHOD THEREFOR

(71) Applicant: BOE TECHNOLOGY GROUP CO., LTD., Beijing (CN)

(72) Inventor: Chul Gyu Jung, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/687,415

(22) Filed: Aug. 25, 2017

(65) Prior Publication Data

US 2018/0114495 A1 Apr. 26, 2018

(30) Foreign Application Priority Data

Oct. 20, 2016 (CN) ..... 2016 1 0916429

(51) Int. Cl.
*G09G 3/36* (2006.01)

(52) U.S. Cl.
CPC ..... *G09G 3/3607* (2013.01); *G09G 3/3677* (2013.01); *G09G 3/3688* (2013.01); *G09G 2300/0426* (2013.01); *G09G 2300/0452* (2013.01); *G09G 2300/0828* (2013.01); *G09G 2310/0235* (2013.01); *G09G 2310/08* (2013.01); *G09G 2320/0242* (2013.01); *G09G 2320/0673* (2013.01)

(58) Field of Classification Search
CPC .. G09G 3/36; G09G 3/34; G09G 5/00; G09G 5/10; G09G 5/02; G06F 3/038
See application file for complete search history.

(56) References Cited

U.S. PATENT DOCUMENTS

2011/0181635 A1* 7/2011 Kabe ..... G09G 3/3426 345/694
2015/0348481 A1* 12/2015 Hong ..... G09G 3/2003 345/690
2016/0063936 A1* 3/2016 Liao ..... G09G 3/3696 345/694
2016/0078826 A1* 3/2016 Yoo ..... G09G 3/3688 345/691
2017/0186353 A1* 6/2017 Hwang ..... G09G 3/2003

* cited by examiner

*Primary Examiner* — Pegeman Karimi
(74) *Attorney, Agent, or Firm* — Kinney & Lange, P.A.

(57) ABSTRACT

The disclosure provides a display panel, a liquid crystal display and a driving method therefor. In the display panel, each of rows and columns of pixels includes primary color pixels and white pixels arranged alternately; primary color pixels and white pixels in each row are electrically connected with different gate lines; primary color pixels in each odd-numbered row have third color, primary color pixels in each even-numbered row are arranged to alternate the first and second colors, and in any two adjacent even-numbered rows, colors of two primary color pixels located in one same column are different from each other; or, primary color pixels in each even-numbered row have third color, primary color pixels in each odd-numbered row are arranged to alternate the first and second colors, and in any two adjacent odd-numbered rows, colors of two primary color pixels located in one same column are different from each other.

20 Claims, 10 Drawing Sheets

DISPLAY PANEL, LIQUID CRYSTAL DISPLAY AND DRIVING METHOD THEREFOR

CROSS-REFERENCE TO RELATED APPLICATION

This application claims the benefit of the Chinese Patent Application No. 201610916429.4 filed on Oct. 20, 2016 in the State Intellectual Property Office of China, the whole disclosure of which is incorporated herein by reference.

TECHNICAL FIELD

Embodiments of the disclosure generally relate to the field of display technologies, and in particular, to a display panel, a liquid crystal display and a driving method therefor.

DESCRIPTION OF THE RELATED ART

Currently, the liquid crystal display is a mainstream display in all of flat panel display technologies. Liquid crystal technology has a wide range of applications, from small-sized consumer products such as a mobile phone, a digital camera and the like to large-sized displays such as a display for a desktop computer, a TV set and the like.

A conventional liquid crystal display is generally provided with a color filter layer for achieving color display. The liquid crystal display often needs be provided with a very thick color filter layer for obtaining high true color, but its light transmittance will become worse, that is, high true color and high light efficiency could not coexist.

SUMMARY

The present disclosure is made to overcome at least one of the above and other issues and defects existing in the prior art.

Embodiments of the present disclosure provide a display panel, a liquid crystal display and a driving method therefor, for at least solving the lower light transmittance in prior art displays.

In one aspect of the disclosure, an embodiment provides a display panel, comprising a plurality of pixels arranged in a matrix, data lines electrically connected with columns of pixels respectively, and gate lines electrically connected with rows of pixels respectively; each row of pixels comprises a plurality of primary color pixels and a plurality of white pixels arranged alternately, and each column of pixels comprises a plurality of primary color pixels and a plurality of white pixels arranged alternately; the color of each primary color pixel is one of a first color, a second color and a third color which are different from a white color; in each row of pixels, all the primary color pixels are electrically connected with one same gate line, all the white pixels are electrically connected with one same gate line, and the primary color pixels and the white pixels are electrically connected with different gate lines; and the primary color pixels and the white pixels are arranged such that: colors of the primary color pixels in each odd-numbered row of pixels are the third color, colors of the primary color pixels in each even-numbered row of pixels are arranged with the first color and the second color alternating with each other, and in any two adjacent even-numbered rows of pixels, colors of two primary color pixels located in one same column are different from each other; or, colors of the primary color pixels in each even-numbered row of pixels are the third color, colors of the primary color pixels in each odd-numbered row of pixels are arranged with the first color and the second color alternating with each other, and in any two adjacent odd-numbered rows of pixels, colors of two primary color pixels located in one same column are different from each other.

In one embodiment of the present disclosure, only one gate line is arranged between two adjacent rows of pixels, and white pixels in two adjacent rows of pixels share one same gate line between the two adjacent rows of pixels.

In one embodiment of the present disclosure, only one gate line is arranged between two adjacent rows of pixels, and primary color pixels in two adjacent rows of pixels share one same gate line between the two adjacent rows of pixels.

In one embodiment of the present disclosure, two gate lines are arranged between two adjacent rows of pixels, one of the two gate lines being electrically connected with all of the white pixels or all of the primary color pixels in one of the two adjacent rows of pixels, the other being electrically connected with all of the white pixels or all of the primary color pixels in the other of the two adjacent rows of pixels.

In one embodiment of the present disclosure, the first color, the second color and the third color are respectively one of a red color, a blue color and a green color.

In one embodiment of the present disclosure, the display panel further comprises: a first gate driver configured for providing a scan signal to all gate lines electrically connected with the white pixels; and a second gate driver configured for providing a scan signal to all gate lines electrically connected with the primary color pixels.

In one embodiment of the present disclosure, the display panel further comprises: a first source driver configured to provide data signals to all odd-numbered data lines; and a second source driver configured to provide data signals to all even-numbered data lines.

In one embodiment of the present disclosure, the display panel further comprises: first control switches electrically connected between and with the first source driver and the odd-numbered data lines respectively; second control switches electrically connected between and with the second source driver and the even-numbered data lines respectively.

In one embodiment of the present disclosure, the display panel further comprises a Gamma correction voltage generation circuit, a timing control circuit, a digital-to-analog conversion circuit and a decoder, and the decoder is configured to control on and off of the first control switches and the second control switches according to a minimum Gamma correction voltage and a maximum Gamma correction voltage generated by the Gamma correction voltage generation circuit, an output voltage from the digital-to-analog conversion circuit and a timing control signal from the timing control circuit.

In another aspect of the present disclosure, an embodiment further provides a liquid crystal display, comprising a liquid crystal display panel and a field sequential driven backlight source for providing a light source for the liquid crystal display panel, the liquid crystal display panel may be the display panel provided by any one of embodiments of the present disclosure, and the field sequential driven backlight source comprises a first color light emitting source, a second color light emitting source and a third color light emitting source.

In a further aspect of the present disclosure, an embodiment further provides a driving method for the liquid crystal display; when the liquid crystal display operates in a first mode, the driving method comprises:

controlling the liquid crystal display panel to refresh the white pixels and the primary color pixel in a preceding $$\frac{T}{N}$$

time duration of a display period T for displaying a frame of image, and controlling the liquid crystal display panel to be in a holding state in a posterior $$\frac{(N-1)T}{N}$$

time duration of the display period T; and controlling the field sequential driven backlight source to light the first color light emitting source, the second color light emitting source and the third color light emitting source sequentially at a frequency of $$\frac{n}{T}$$

during the display period T for displaying a frame of image;

where n is an integer larger than or equal to N, and N is an integer larger than one and has a value determined by characteristics of a thin film transistor in the display panel.

In one embodiment of the present disclosure, when the liquid crystal display operates in a second mode, the driving method further comprises:

controlling the liquid crystal display panel to refresh the primary color pixels in a preceding $$\frac{T}{N}$$

time duration of the display period T for displaying a frame of image, and controlling the liquid crystal display panel to be in a holding state in a posterior $$\frac{(N-1)T}{N}$$

time duration of the display period T; and controlling the field sequential driven backlight source to light the first color light emitting source, the second color light emitting source and the third color light emitting source sequentially at a frequency of $$\frac{n}{T},$$

or controlling the field sequential driven backlight source to light the first color light emitting source, the second color light emitting source and the third color light emitting source simultaneously, during the display period T for displaying a frame of image.

In one embodiment of the present disclosure, when the liquid crystal display operates in a third mode, the driving method further comprises:

controlling the liquid crystal display panel to refresh the primary color pixels and controlling the liquid crystal display panel such that the white pixels are in a fully-transmitting state in a preceding $$\frac{T}{N}$$

time duration of the display period T for displaying a frame of image, and controlling the liquid crystal display panel to be in a holding state in a posterior $$\frac{(N-1)T}{N}$$

time duration of the display period T; and controlling the field sequential driven backlight source to emit no light during the display period T for displaying a frame of image.

DETAILED DESCRIPTION OF PREFERRED EMBODIMENTS

In order to make the objects, technical solutions and advantages more clear, the disclosure will be described in further detail with reference to the accompanying drawings. Obviously, the described embodiments are merely a part of embodiments of the disclosure, rather than being all embodiments thereof. Based on the embodiments of the disclosure, all other embodiments arrived at by those ordinary skilled in the art without any inventive step will fall within the scope of the disclosure.

The shapes and sizes of parts in the accompanying drawings will not reflect the true scales thereof, rather are only intended to illustrate the disclosure.

In order to improve resolution of a liquid crystal display, a color field sequential display where a liquid crystal display panel provided with no color filter and a field sequential driven OLED backlight source are combined has been developed. Working principle of the color field sequential display is described as follows: when displaying a frame of image, pixels of liquid crystal display panel displays corresponding gray scales respectively, while a time period for displaying the frame of image is divided into three phases such that the field sequential driven OLED backlight source will light R, G, B pixels sequentially depending on the corresponding phases, for example, light an R pixel during a first phase, light a G pixel during a second phase and light a B pixel during a third phase, thereby the liquid crystal display panel and the field sequential driven OLED backlight source cooperate to achieve normal display through persistence of vision effect of human eyes and combination in brain. Further, the number of the pixels of the color field sequential display is only one third of that in a conventional liquid crystal display provided with color filters.

Figure 1A:
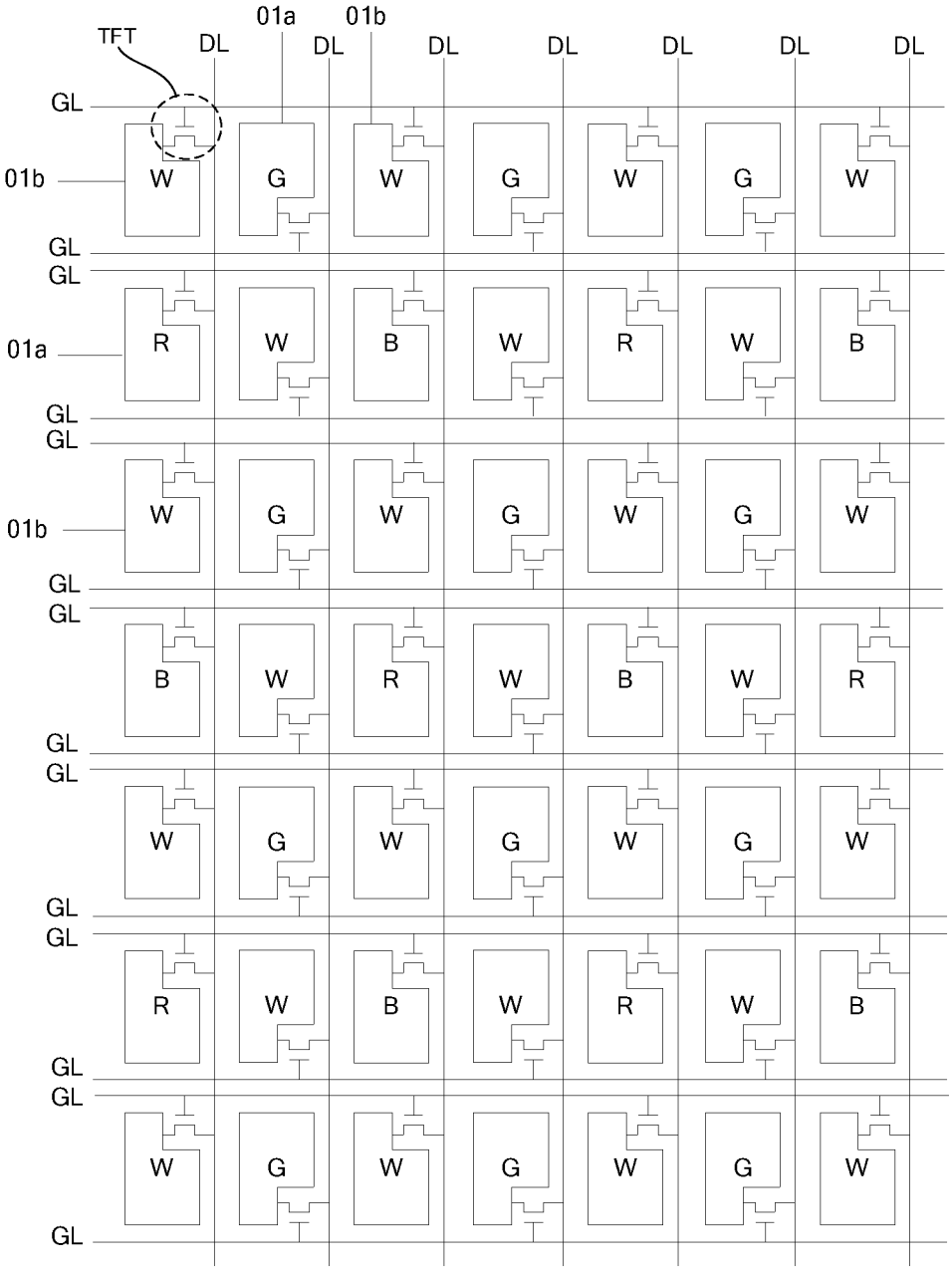
FIG. 1*a* to FIG. 1*d* are schematic structural diagrams showing display panels according to embodiments of the present disclosure respectively.
Figure 1B:
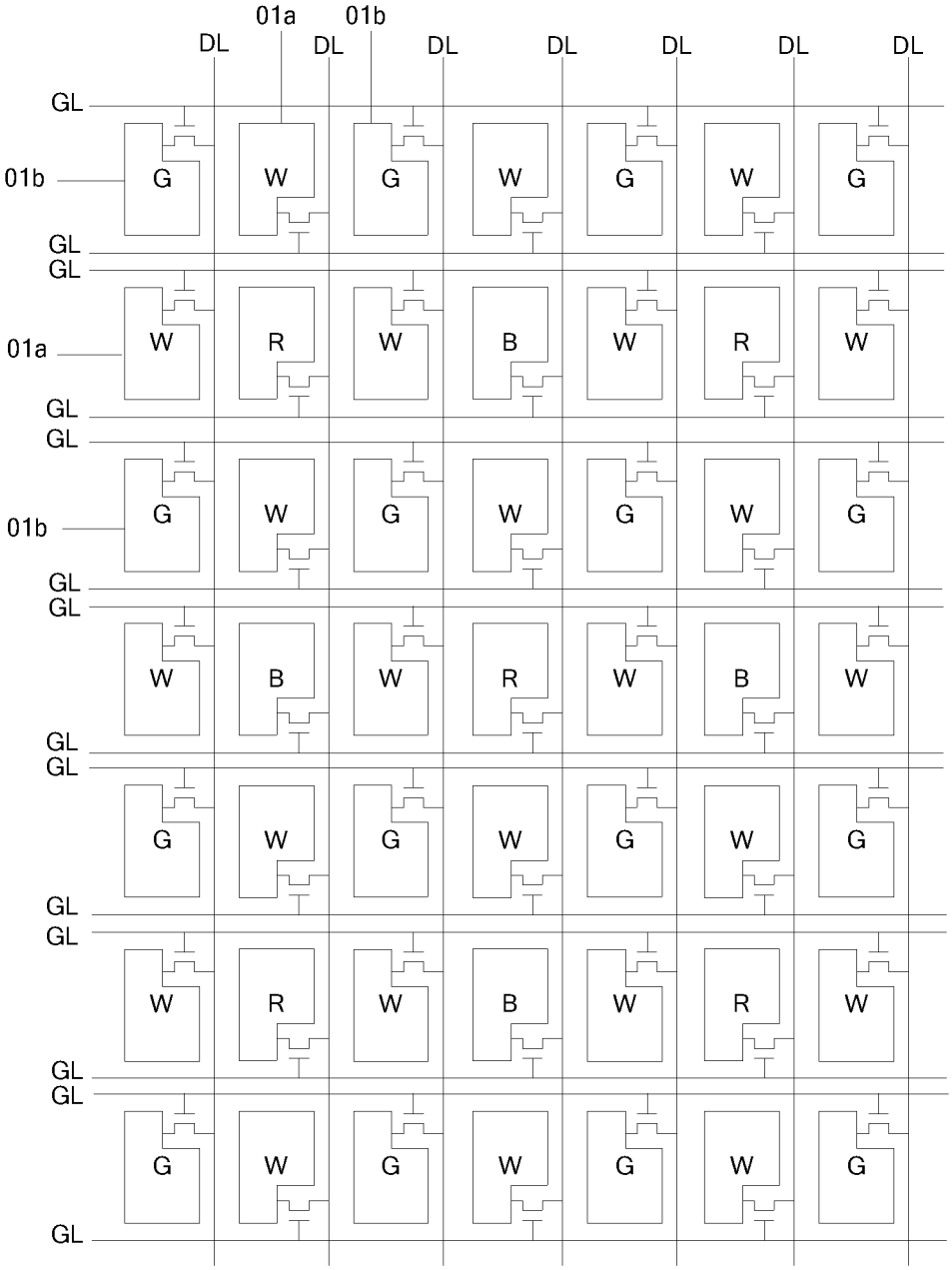
Figure 1C:
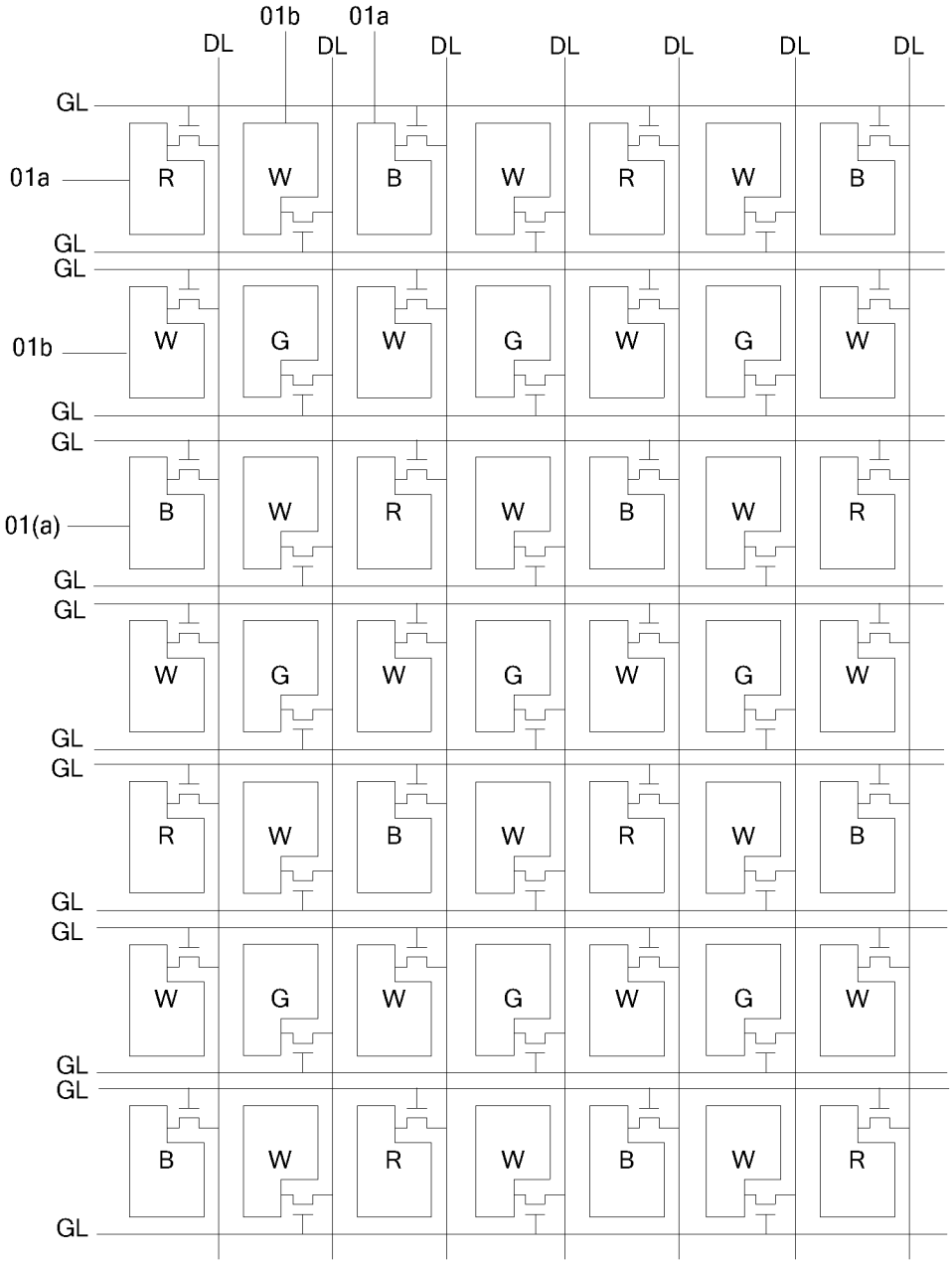
Figure 1D:
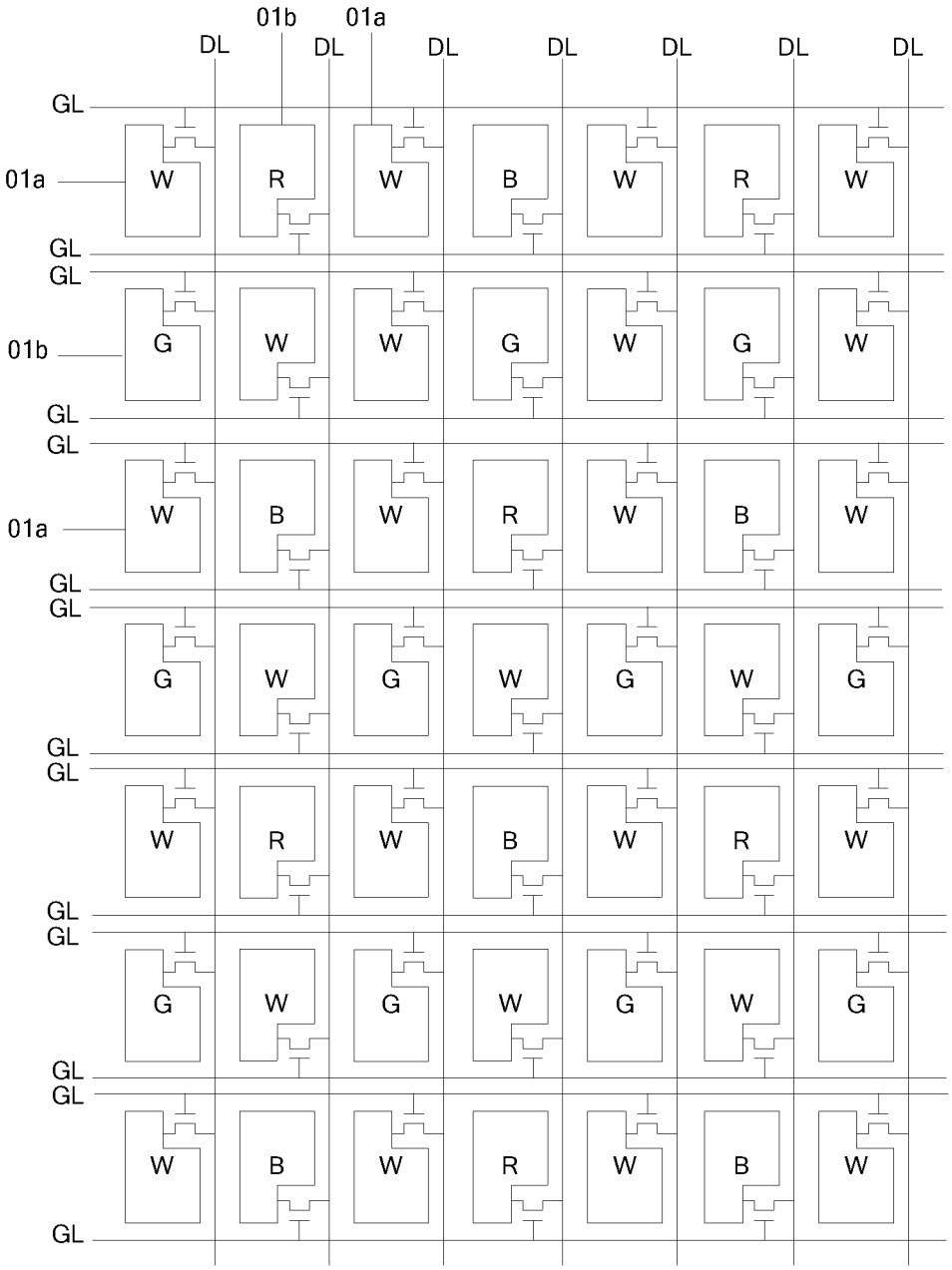

An embodiment of the present disclosure provides a display panel, as shown in FIG. 1*a* to FIG. 1*d*, comprising a plurality of pixels arranged in a matrix, data lines DL electrically connected with columns of pixels respectively, and gate lines GL electrically connected with rows of pixels respectively, each row of pixels comprises a plurality of primary color pixels 01*a* and a plurality of white pixels 01*b* arranged alternately, and each column of pixels comprises a plurality of primary color pixels 01*a* and a plurality of white pixels 01*b* arranged alternately; in an example, the color of each primary color pixel 01*a* is one of a first color, a second color and a third color;

As shown in FIG. 1*a* and FIG. 1*b*, colors of the primary color pixels 01*a* in each odd-numbered row of pixels are the third color, colors of the primary color pixels 01*a* in each even-numbered row of pixels are arranged with the first color and the second color alternating with each other, and in any two adjacent even-numbered rows of pixels, colors of two primary color pixels 01*a* located in one same column are different from each other; or, As shown in FIG. 1*c* and FIG. 1*d*, colors of the primary color pixels 01*a* in each even-numbered row of pixels are the third color, colors of the primary color pixels 01*a* in each odd-numbered row of pixels are alternately configured as the first color and the second color, and in any two adjacent odd-numbered rows of pixels, colors of two primary color pixels 01*a* located in one same column are different from each other;

In each row of pixels, all the primary color pixels 01*a* are electrically connected with one same gate line GL, all the white pixels 01*b* are electrically connected with one same gate line GL, and the primary color pixels 01*a* and the white pixels 01*b* are electrically connected with different gate lines.

Exemplarily, each pixel or pixel unit may comprises a pixel electrode (for example, located at a position corresponding to R, G, B, W in FIG. 1*a* to FIG. 3) and a thin film transistor (TFT, as shown in FIG. 1*a*), a gate of the thin film transistor is connected to a corresponding gate line, one of a source electrode and a drain electrode of the thin film transistor is connected to a corresponding data line, and the other one is connected to a corresponding pixel electrode, such that each pixel or pixel unit is electrically connected with the corresponding data line and gate line through the thin film transistor, and a scan signal may be supplied to the pixel or pixel unit through the gate line and a data signal may be supplied to the pixel or pixel unit through the data line.

In the display panel provided according to embodiments of the present disclosure, the primary color pixels and the white pixels are arranged alternately; as such, when the display panel cooperates with a field sequential driven backlight source, light from the backlight source may be transmitted through the white pixels to be directly emitted out, thereby the light transmittance of the display panel may be improved. Further, since the display panel is still provided with the primary color pixels, the high true color of the displayed image may be ensured. Moreover, in the display panel, colors of the primary color pixels in each odd-numbered row of pixels are the third color, colors of the primary color pixels in each even-numbered row of pixels are alternately configured as the first color and the second color, and in any two adjacent even-numbered rows of pixels, colors of two primary color pixels located in one same column are different from each other; or, colors of the primary color pixels in each even-numbered row of pixels are the third color, colors of the primary color pixels in each odd-numbered row of pixels are alternately configured as the first color and the second color, and in any two adjacent odd-numbered rows of pixels, colors of two primary color pixels located in one same column are different from each other. Thereby, colors of light emitted from the field sequential driven backlight source may be changed within a time duration of a frame such that the white pixels and two adjacent primary color pixels are combined for many times, which is equivalent to operation effect of a plurality of display pixels; while in a conventional liquid crystal display, each display pixel is composed of three pixels (R, G and B), and the larger the number of R, G and B pixels is, the larger the number of the data lines is. Thus, when the same resolution is desired, the number of the data lines in the display panel of embodiments of the present disclosure is far less than the number of the data lines in the conventional liquid crystal display, thereby further improving the light transmittance of the display panel. In addition, in each row of pixels, all the primary color pixels are electrically connected with one same gate line, all the white pixels are electrically connected with one same gate line, and the primary color pixels and the white pixels are electrically connected with different gate lines, such that the primary color pixels and the white pixels may be separately controlled to achieve different display or working modes.

In some embodiments of the present disclosure, the display panel may be provided with a color filter layer including color filters, which may be respectively disposed within regions corresponding to the primary color pixels and have colors corresponding to (for example, same as) those of the primary color pixels. The first color, the second color and the third color are different from one another and are all not white color.

In the embodiments shown in FIG. 1*a* to FIG. 1*d*, two gate lines GL are arranged between two adjacent rows of pixels, one of the two gate lines being electrically connected with all of the white pixels 01*b* or all of the primary color pixels 01*a* in one of the two adjacent rows of pixels, the other being electrically connected with all of the white pixels 01*b* or all of the primary color pixels 01*a* in the other of the two adjacent rows of pixels.

Figure 2A:
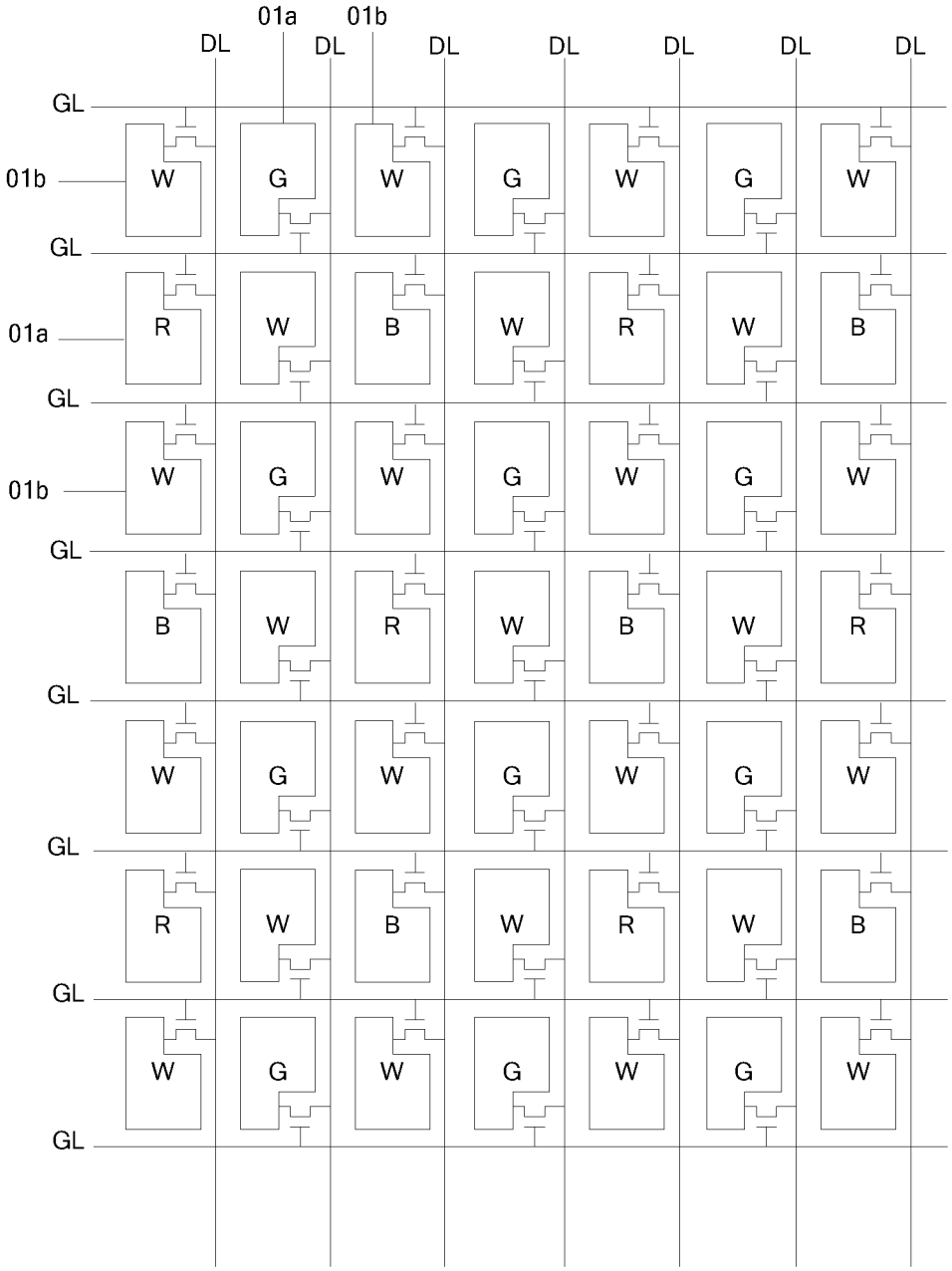
FIG. 2*a* and FIG. 2*b* are schematic structural diagrams showing display panels according to embodiments of the present disclosure respectively.
Figure 2B:
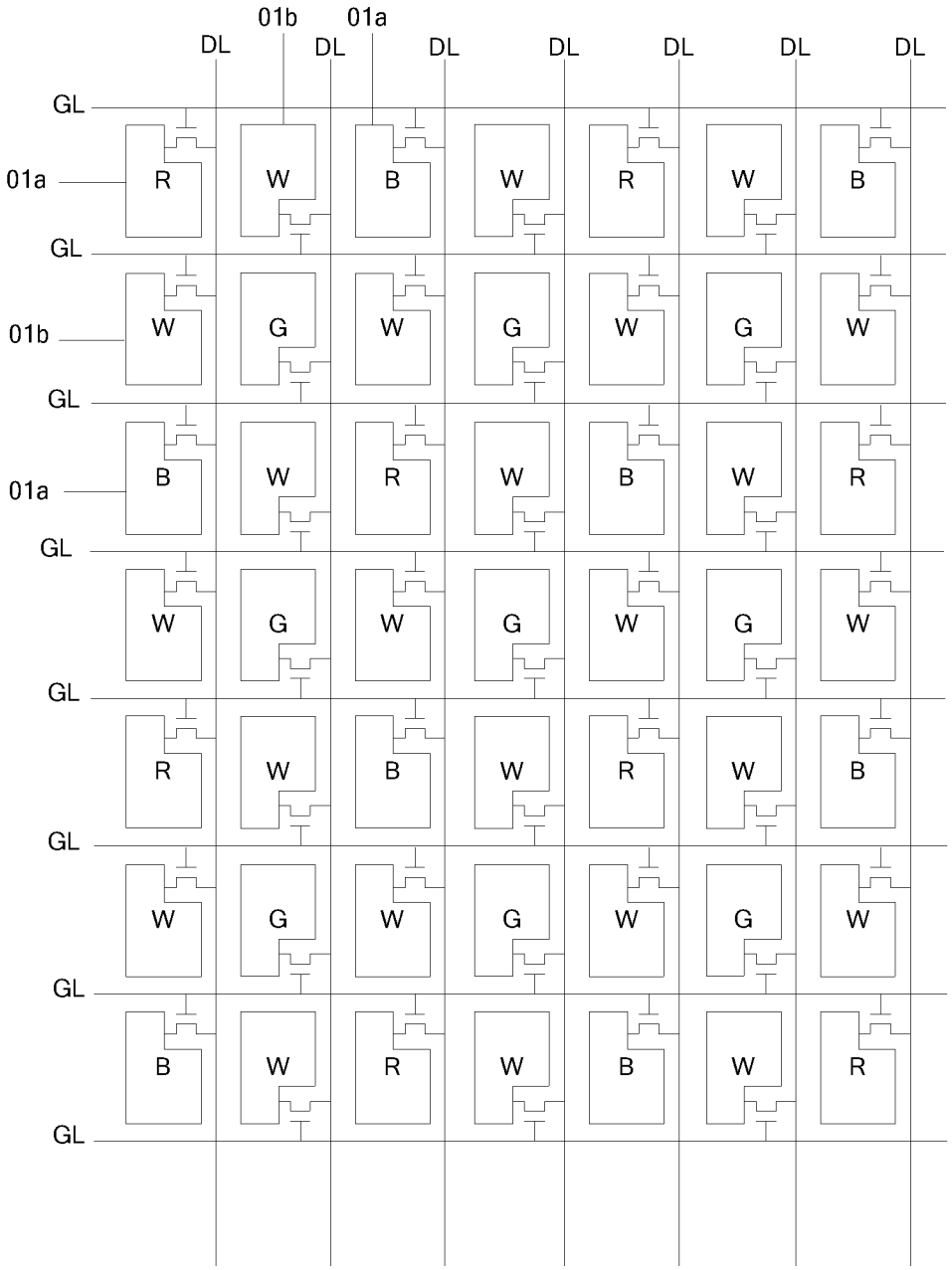

In other embodiments of the present disclosure, as shown in FIG. 2*a* and FIG. 2*b*, in order to increase an aperture ratio of the display panel, only one gate line GL is arranged between two adjacent rows of pixels, and the white pixels 01*b* in two adjacent rows of pixels share or are electrically connected with one same gate line between the two adjacent rows of pixels, and/or the primary color pixels 01*a* in two adjacent rows of pixels share or are electrically connected with one same gate line GL between the two adjacent rows of pixels.

In some embodiments of the present disclosure, the first color, the second color and the third color are respectively one of a red color, a blue color and a green color.

Figure 3:
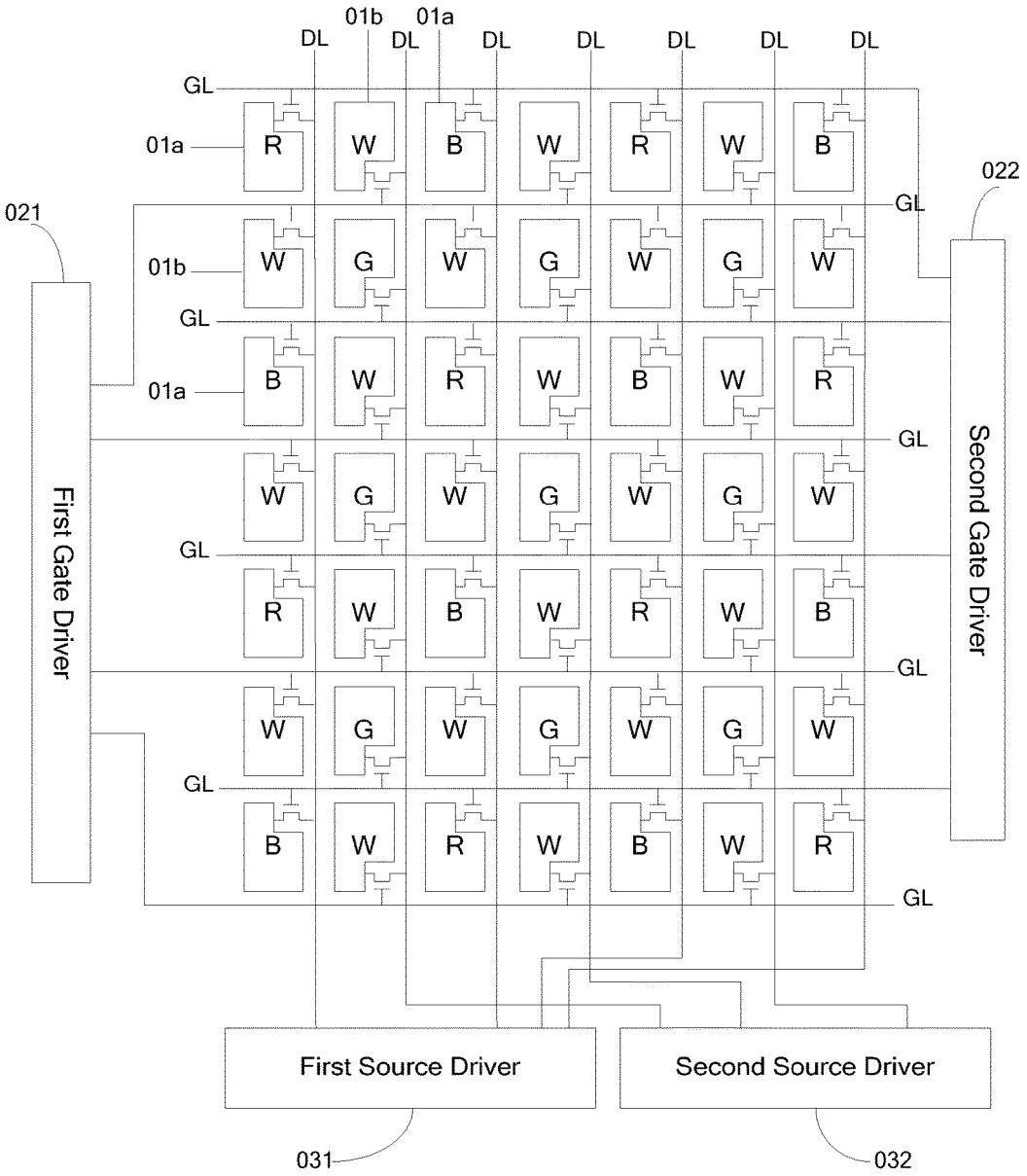
FIG. 3 is a schematic structural diagram showing a display panel according to an embodiment of the present disclosure.

In some embodiments, in order to separately control the primary color pixels and the white pixels to achieve many display modes, the display panel further comprises: a first gate driver 201 configured to provide a scan signal to all gate lines GL electrically connected with the white pixels 01*b*, and a second gate driver 022 configured to provide a scan signal to all gate lines GL electrically connected with the primary color pixels 01*a*, as shown in FIG. 3.

In some embodiments, in order to separately control the primary color pixels and the white pixels to achieve many display modes, the display panel further comprises: a first source driver 031 configured to provide data signals to all odd-numbered data lines DL, and a second source driver 032 configured to provide data signals to all even-numbered data lines DL, as shown in FIG. 3.

It is noted that in FIG. 1*a* to FIG. 3, R represents that a color of a primary color pixel 01*a* is red color, G represents that a color of a primary color pixel 01*a* is green color, B represents that a color of a primary color pixel 01*a* is blue color, W represents that a color of a white pixel 01*b* is white color.

Figure 4:
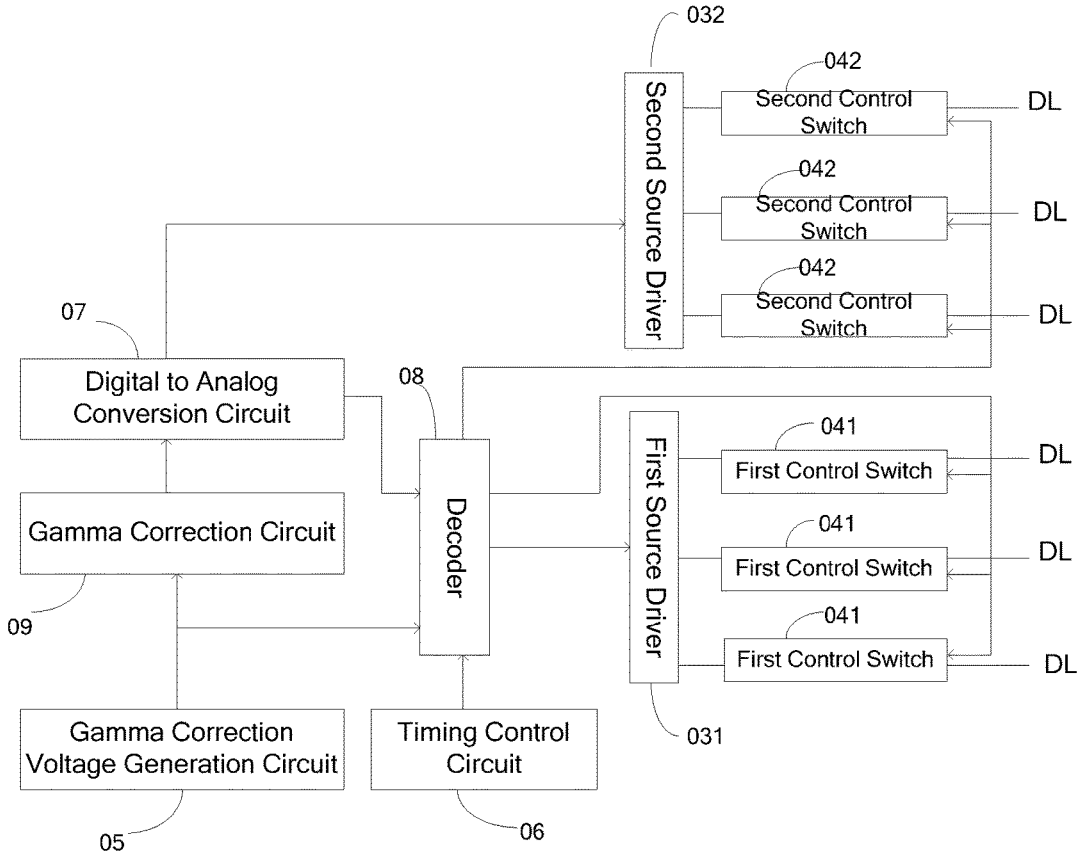
FIG. 4 is a schematic structural diagram showing a display panel according to an embodiment of the present disclosure.

In some embodiments, in order to separately control the primary color pixels and the white pixels, the display panel further comprises: first control switches 041 electrically connected between and with the first source driver 031 and the odd-numbered data lines DL respectively; and second control switches 042 electrically connected between and with the second source driver and the even-numbered data lines respectively, as shown in FIG. 4.

In some embodiments, as shown in FIG. 4, the display panel further comprises a Gamma correction voltage generation circuit 05, a timing control circuit 06, a digital-to-analog conversion circuit 07 and a decoder 08; the decoder 08 is configured to control the first control switches 041 and the second control switches 042 to turn on or turn off according to a minimum Gamma correction voltage and a maximum Gamma correction voltage generated by the Gamma correction voltage generation circuit 05, an output voltage from the digital-to-analog conversion circuit 07 and a timing control signal from the timing control circuit 06.

In some embodiments of the present disclosure, as shown in FIG. 4, the display panel further comprises a Gamma correction circuit 09 electrically connected between and with the Gamma correction voltage generation circuit 05 and the digital-to-analog conversion circuit 07. Further, the digital-to-analog conversion circuit 07 is electrically connected with the second source driver 032, and the decoder 08 is electrically connected with the first source driver 031.

Based on the same inventive concept, an embodiment of the present disclosure further provides a liquid crystal display, comprising a liquid crystal display panel and a field sequential driven backlight source for providing a light source for the liquid crystal display panel, the liquid crystal display panel may be the display panel described in any one of embodiments of the present disclosure, and the field sequential driven backlight source comprises a first color light emitting source, a second color light emitting source and a third color light emitting source. The principle of the liquid crystal display for solving problems is similar to that of the above display panel, thus implementation of the liquid crystal display may refer to implementations of the above display panels and will not be repeatedly described.

In the liquid crystal display provided according to embodiments of the present disclosure, the primary color pixels and the white pixels of the liquid crystal display panel are arranged alternately, thus when the liquid crystal display panel cooperates with the field sequential driven backlight source, light from the backlight source may be transmitted through the white pixels to be directly emitted out, thereby the light transmittance of the display panel may be improved. Further, since the display panel is still provided with the primary color pixels, the high true color of the displayed image may be ensured. Moreover, when the same resolution is desired, the number of the data lines in the liquid crystal display of embodiments of the present disclosure is far less than the number of the data lines in the conventional liquid crystal display, thereby further improving the light transmittance of the liquid crystal display. In addition, in each row of pixels, all the primary color pixels are electrically connected with one same gate line, all the white pixels are electrically connected with one same gate line, and the primary color pixels and the white pixels are electrically connected with different gate lines, such that the primary color pixels and the white pixels may be separately controlled to achieve different displaying or working modes.

Based on the same inventive concept, an embodiment of the present disclosure further provides a driving method for the liquid crystal display; when the liquid crystal display operates in a first mode, the driving method comprises:

controlling the liquid crystal display panel to refresh the white pixels and the primary color pixel in a preceding $$\frac{T}{N}$$

time duration of a display period T for displaying a frame of image, and controlling the liquid crystal display panel to be in a holding state in a posterior $$\frac{(N-1)T}{N}$$

time duration of the display period T; and controlling the field sequential driven backlight source to light the first color light emitting source, the second color light emitting source and the third color light emitting source sequentially at a frequency of $$\frac{n}{T}$$

during the display period T for displaying a frame of image;

where n is an integer larger than or equal to N, and N is an integer larger than one and is determined by characteristics of a thin film transistor in the display panel.

As such, the primary color pixels and the white pixels may be controlled to display, such that a high quality display effect may be obtained.

Exemplarily, n may be four.

In some embodiments of the present disclosure, when the liquid crystal display operates in a second mode, the driving method may further comprise:

controlling the liquid crystal display panel to refresh the primary color pixels in a preceding $$\frac{T}{N}$$

time duration of the display period T for displaying a frame of image, and controlling the liquid crystal display panel to be in a holding state in a posterior $$\frac{(N-1)T}{N}$$

time duration of the display period T; and controlling the field sequential driven backlight source to light the first color light emitting source, the second color light emitting source and the third color light emitting source sequentially at a frequency of $$\frac{n}{T},$$

or controlling the field sequential driven backlight source to light the first color light emitting source, the second color light emitting source and the third color light emitting source simultaneously, during the display period T for displaying a frame of image.

As such, only the primary color pixels are controlled to display, thereby reducing power consumption of the liquid crystal display.

In some embodiments of the present disclosure, when the liquid crystal display operates in a third mode, the driving method further comprises:

controlling the liquid crystal display panel to refresh the primary color pixels and controlling the liquid crystal display panel such that the white pixels are in a fully-transmitting state in a preceding $$\frac{T}{N}$$

time duration of the display period T for displaying a frame of image, and controlling the liquid crystal display panel to be in a holding state in a posterior $$\frac{(N-1)T}{N}$$

time duration of the display period T; and controlling the field sequential driven backlight source to emit no light during the display period T for displaying a frame of image.

As such, the white pixels are controlled to be in a fully-transmitting state and the primary color pixels are controlled for displaying, thereby enabling a transparent display effect.

Exemplarily, in the driving method according to embodiments of the present disclosure, the white pixels will be in a fully-transmitting state when being not charged if the liquid crystal display is a normal-white mode display, and the white pixels will be in a fully-transmitting state when being charged if the liquid crystal display is a normal-black mode display.

Hereinafter, a driving method for the liquid crystal display according to embodiments of the present disclosure will be described by taking the display panel shown in FIG. 3 as an example, in conjunction with the timing diagrams. In an embodiment, an example where N=3, n=3, the first color is red color, the second color is green color, and the third color is blue color will be described.

Figure 5A:
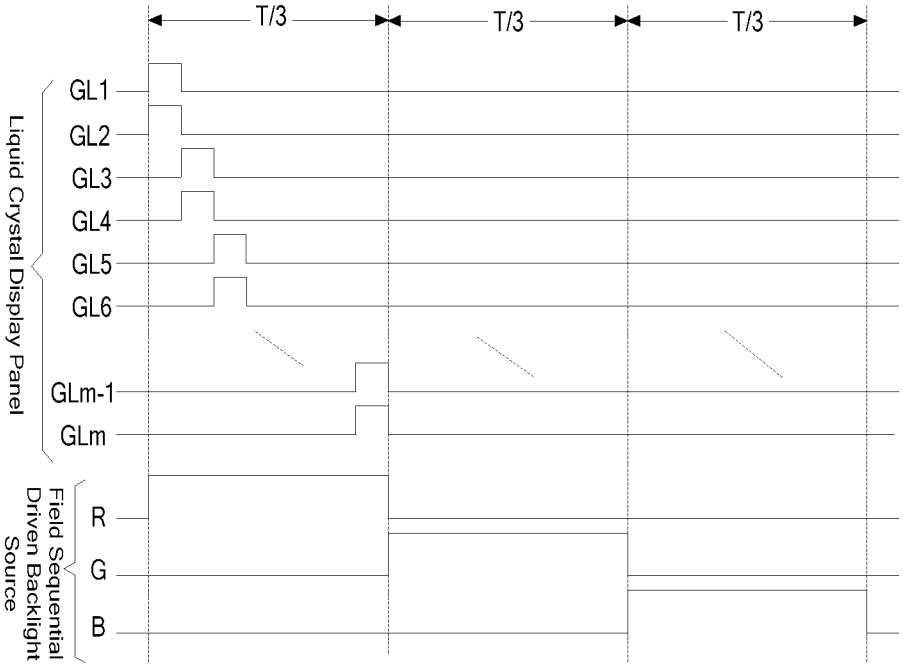
FIG. 5*a* to FIG. 5*c* are timing diagrams showing three working modes according to embodiments of the present disclosure respectively.

(1) If the liquid crystal display operates in a first mode, when displaying a frame of image: as shown in FIG. 5*a*, the liquid crystal display panel is controlled to refresh the white pixels and the primary color pixels in a preceding $$\frac{T}{3}$$

time duration of a display period T; that is, the second gate driver sequentially outputs a scan signal to odd-numbered gate lines GL1, GL3, GL5, . . . , GLm−1, and at the same time, and the first gate driver sequentially outputs a scan signal to even-numbered gate lines GL2, GL4, GL6, . . . , GLm, where m is an even number;

the liquid crystal display panel is controlled to be in a holding state, that is, the first gate driver and the second gate driver do not output any scan signal, in a posterior $$\frac{2T}{3}$$

time duration of the display period T; and the field sequential driven backlight source is controlled to light the first color light emitting source, the second color light emitting source and the third color light emitting source sequentially at a frequency of $$\frac{n}{T}$$

during the display period T; that is, the first color light emitting source R is lit in a preceding $$\frac{T}{3}$$

time duration of the display period T, the second color light emitting source G is lit in a middle $$\frac{T}{3}$$

time duration of the display period T, and the third color light emitting source B is lit in a posterior $$\frac{T}{3}$$

time duration of the display period T.

Figure 5B:
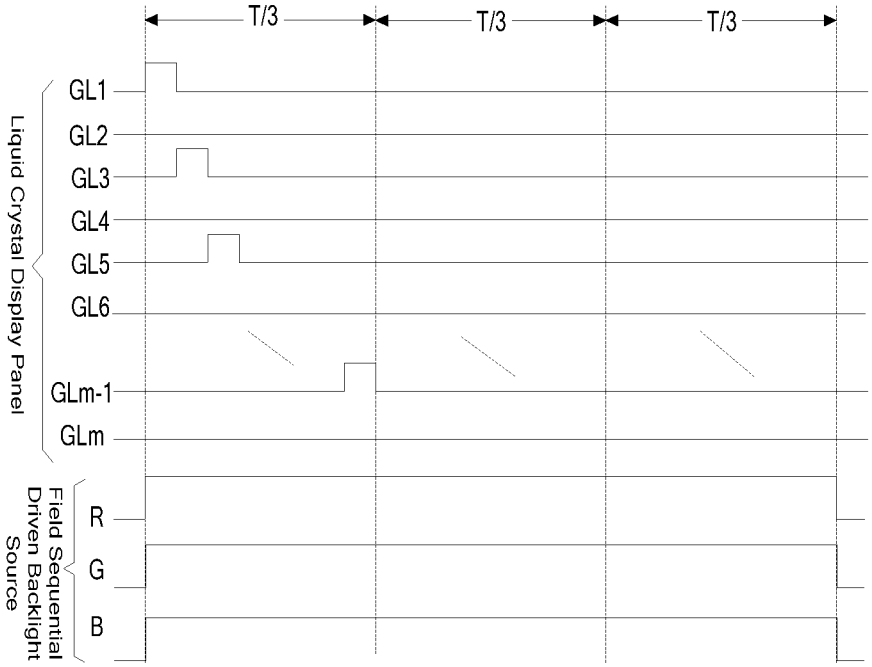

(2) If the liquid crystal display operates in a second mode, when displaying a frame of image: as shown in FIG. 5*b*, the liquid crystal display panel is controlled to refresh the primary color pixels, that is, the second gate driver sequentially outputs a scan signal to the odd-numbered gate lines GL1, GL3, GL5, . . . , GLm−1, in a preceding $$\frac{T}{3}$$

time duration of the display period T;

the liquid crystal display panel is controlled to be in a holding state, that is, the first gate driver and the second do not output any scan signal, in a posterior $$\frac{2T}{3}$$

time duration of the display period T; and the field sequential driven backlight source is controlled to turn on the first color light emitting source R, the second color light emitting source G and the third color light emitting source B simultaneously, during the display period T.

Figure 5C:
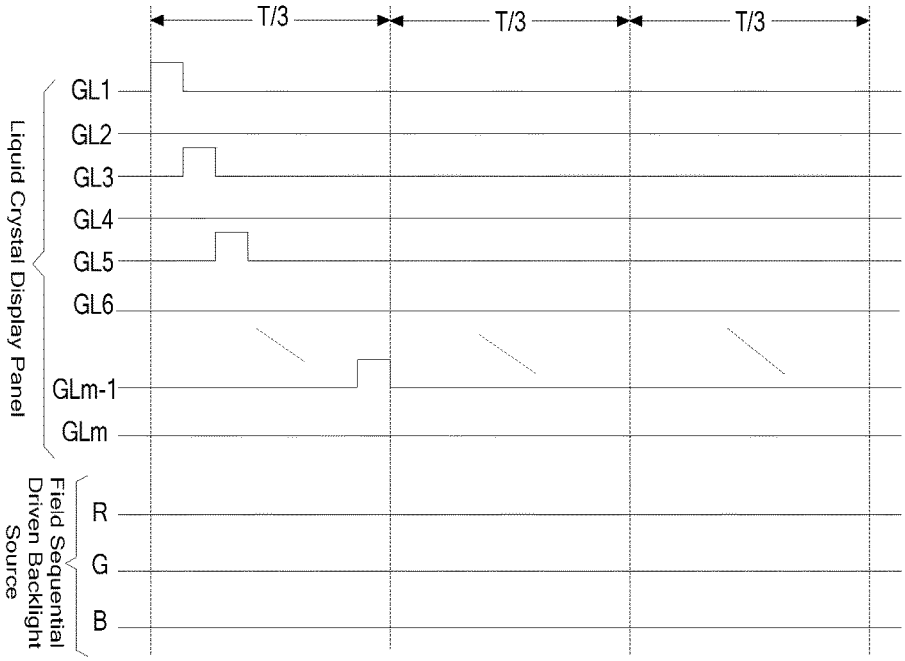

(3) If the liquid crystal display operates in a third mode, when displaying a frame of image: as shown in FIG. 5*c*, the liquid crystal display panel is controlled to refresh the primary color pixels, that is, the second gate driver sequentially outputs a scan signal to the odd-numbered gate lines GL1, GL3, GL5, . . . , GLm−1, in a preceding $$\frac{T}{N}$$

time duration of the display period T;

the liquid crystal display panel is controlled such that the white pixels are in a fully-transmitting state in the preceding $$\frac{T}{N}$$

time duration of the display period T; it is assumed that the liquid crystal display panel is in a normal-white mode, that is, the second gate driver does not output any scan signal;

the liquid crystal display panel is controlled to be in a holding state, that is, the first gate driver and the second gate driver do not output any scan signal, in a posterior $$\frac{2T}{3}$$

time duration of the display period T; and the field sequential driven backlight source is controlled to emit no light, that is, the first color light emitting source R, the second color light emitting source G and the third color light emitting source B do not emit light, during the display period T.

In an implementation, the above driving method provided according to embodiments of the present disclosure may determine working modes of the liquid crystal display based on applications where the liquid crystal display is used.

In the display panel, the liquid crystal display and the driving method therefor provided according to embodiments of the present disclosure, the primary color pixels and the white pixels are arranged alternately is the display panel; as such, when the display panel cooperates with the field sequential driven backlight source, light from the backlight source may be transmitted through the white pixels to be directly emitted out, thereby the light transmittance of the display panel may be improved. Further, since the display panel is still provided with the primary color pixels, the high true color of the displayed image may be ensured. Moreover, in the display panel, colors of the primary color pixels in each odd-numbered row of pixels are the third color, colors of the primary color pixels in each even-numbered row of pixels are alternately configured as the first color and the second color, and in any two adjacent even-numbered rows of pixels, colors of two primary color pixels located in one same column are different from each other; or, colors of the primary color pixels in each even-numbered row of pixels are the third color, colors of the primary color pixels in each odd-numbered row of pixels are arranged with the first color and the second color alternating with each other, and in any two adjacent odd-numbered rows of pixels, colors of two primary color pixels located in one same column are different from each other. Thereby, colors of light emitted from the field sequential driven backlight source may be changed within a time frame such that the white pixels and two adjacent primary color pixels are combined for many times, which is equivalent to operation effect of a plurality of display pixels; while in a conventional liquid crystal display, each display pixel is composed of three pixels (R, G and B), and the larger the number of R, G and B pixels is, the larger the number of the data lines is. Thus, when the same resolution is desired, the number of the data lines in the display panel of embodiments of the present disclosure is far less than the number of the data lines in the conventional liquid crystal display, thereby further improving the light transmittance of the display panel. In addition, in each row of pixels, all the primary color pixels are electrically connected with one same gate line, all the white pixels are electrically connected with one same gate line, and the primary color pixels and the white pixels are electrically connected with different gate lines, such that the primary color pixels and the white pixels may be separately controlled to achieve different displaying or working modes.

Obviously, those skilled in the art may make various changes and modifications without departing from the spirit and scope of the disclosure. In this way, if these changes and modifications of the disclosure fall within the scope claimed in claims and their equivalents, the disclosure is also intended to include these changes and modifications.

What is claimed is:

1. A display panel, comprising a plurality of pixels arranged in a matrix, data lines electrically connected with columns of pixels respectively, and gate lines electrically connected with rows of pixels respectively, wherein:

each row of pixels comprises a plurality of primary color pixels and a plurality of white pixels arranged alternately, and each column of pixels comprises a plurality of primary color pixels and a plurality of white pixels arranged alternately;

a color of each primary color pixel is one of a first color, a second color and a third color which are different from a white color;

in each row of pixels, all the primary color pixels are electrically connected with one same gate line, all the white pixels are electrically connected with one same gate line, and the primary color pixels and the white pixels are electrically connected with different gate lines; and the primary color pixels and the white pixels are arranged such that:

colors of the primary color pixels in each odd-numbered row of pixels are the third color, colors of the primary color pixels in each even-numbered row of pixels are arranged with the first color and the second color alternating with each other, and in any two adjacent even-numbered rows of pixels, colors of two primary color pixels located in one same column are different from each other; or colors of the primary color pixels in each even-numbered row of pixels are the third color, colors of the primary color pixels in each odd-numbered row of pixels are arranged with the first color and the second color alternating with each other, and in any two adjacent odd-numbered rows of pixels, colors of two primary color pixels located in one same column are different from each other.

2. The display panel according to claim 1, wherein:

only one gate line is arranged between two adjacent rows of pixels; and white pixels in two adjacent rows of pixels share one same gate line between the two adjacent rows of pixels.

3. The display panel according to claim 2, further comprising:

a first gate driver configured for providing a scan signal to all gate lines electrically connected with the white pixels; and a second gate driver configured for providing a scan signal to all gate lines electrically connected with the primary color pixels.

4. The display panel according to claim 3, further comprising:

a first source driver configured to provide data signals to all odd-numbered data lines; and a second source driver configured to provide data signals to all even-numbered data lines.

5. The display panel according to claim 4, further comprising:

first control switches electrically connected between and with the first source driver and the odd-numbered data lines respectively; and second control switches electrically connected between and with the second source driver and the even-numbered data lines respectively.

6. The display panel according to claim 1, wherein:

only one gate line is arranged between two adjacent rows of pixels; and primary color pixels in two adjacent rows of pixels share one same gate line between the two adjacent rows of pixels.

7. The display panel according to claim 6, further comprising:

a first gate driver configured for providing a scan signal to all gate lines electrically connected with the white pixels; and a second gate driver configured for providing a scan signal to all gate lines electrically connected with the primary color pixels.

8. The display panel according to claim 7, further comprising:

a first source driver configured to provide data signals to all odd-numbered data lines; and a second source driver configured to provide data signals to all even-numbered data lines.

9. The display panel according to claim 8, further comprising:

first control switches electrically connected between and with the first source driver and the odd-numbered data lines respectively; and second control switches electrically connected between and with the second source driver and the even-numbered data lines respectively.

10. The display panel according to claim 1, wherein two gate lines are arranged between two adjacent rows of pixels, one of the two gate lines being electrically connected with all of the white pixels or all of the primary color pixels in one of the two adjacent rows of pixels, the other of the two gate lines being electrically connected with all of the white pixels or all of the primary color pixels in the other of the two adjacent rows of pixels.

11. The display panel according to claim 1, wherein the first color, the second color and the third color are respectively one of a red color, a blue color and a green color.

12. The display panel according to claim 1, further comprising:

a first gate driver configured for providing a scan signal to all gate lines electrically connected with the white pixels; and a second gate driver configured for providing a scan signal to all gate lines electrically connected with the primary color pixels.

13. The display panel according to claim 12, further comprising:

a first source driver configured to provide data signals to all odd-numbered data lines; and a second source driver configured to provide data signals to all even-numbered data lines.

14. The display panel according to claim 13, further comprising:

first control switches electrically connected between and with the first source driver and the odd-numbered data lines respectively; and second control switches electrically connected between and with the second source driver and the even-numbered data lines respectively.

15. The display panel according to claim 14, further comprising a Gamma correction voltage generation circuit, a timing control circuit, a digital-to-analog conversion circuit and a decoder;

wherein the decoder is configured to control turning on and off of the first control switches and the second control switches according to a minimum Gamma correction voltage and a maximum Gamma correction voltage generated by the Gamma correction voltage generation circuit, an output voltage from the digital-to-analog conversion circuit, and a timing control signal from the timing control circuit.

16. A liquid crystal display, comprising a liquid crystal display panel and a field sequential driven backlight source for providing a light source for the liquid crystal display panel, wherein the liquid crystal display panel is the display panel of claim 1, and the field sequential driven backlight source comprises a first color light emitting source, a second color light emitting source and a third color light emitting source.

17. A driving method for the liquid crystal display of claim 16, wherein when the liquid crystal display operates in a first mode, the driving method comprises:

controlling the liquid crystal display panel to refresh the white pixels and the primary color pixel in a preceding $$\frac{T}{N}$$

time duration of a display period T for displaying a frame of image, and controlling the liquid crystal display panel to be in a holding state in a posterior $$\frac{(N-1)T}{N}$$

time duration of the display period T; and controlling the field sequential driven backlight source to light the first color light emitting source, the second color light emitting source and the third color light emitting source sequentially at a frequency of $$\frac{n}{T}$$

during the display period T for displaying a frame of image;

where n is an integer larger than or equal to N, and N is an integer larger than one and has a value determined by characteristics of a thin film transistor in the display panel.

18. The driving method according to claim 17, wherein when the liquid crystal display operates in a second mode, the driving method further comprises:

controlling the liquid crystal display panel to refresh the primary color pixels in a preceding $$\frac{T}{N}$$

time duration of the display period T for displaying a frame of image, and controlling the liquid crystal display panel to be in a holding state in a posterior $$\frac{(N-1)T}{N}$$

time duration of the display period T; and controlling the field sequential driven backlight source to light the first color light emitting source, the second color light emitting source and the third color light emitting source sequentially at a frequency of $$\frac{n}{T},$$

or controlling the field sequential driven backlight source to light the first color light emitting source, the second color light emitting source and the third color light emitting source simultaneously, during the display period T for displaying a frame of image.

19. The driving method according to claim 18, wherein when the liquid crystal display operates in a third mode, the driving method further comprises:

controlling the liquid crystal display panel to refresh the primary color pixels and controlling the liquid crystal display panel such that the white pixels are in a fully-transmitting state in a preceding $$\frac{T}{N}$$

time duration of the display period T for displaying a frame of image, and controlling the liquid crystal display panel to be in a holding state in a posterior $$\frac{(N-1)T}{N}$$

time duration of the display period T; and controlling the field sequential driven backlight source to emit no light during the display period T for displaying a frame of image.

20. The driving method according to claim 17, wherein when the liquid crystal display operates in a third mode, the driving method further comprises:

controlling the liquid crystal display panel to refresh the primary color pixels and controlling the liquid crystal display panel such that the white pixels are in a fully-transmitting state in a preceding $$\frac{T}{N}$$

time duration of the display period T for displaying a frame of image, and controlling the liquid crystal display panel to be in a holding state in a posterior $$\frac{(N-1)T}{N}$$

time duration of the display period T; and controlling the field sequential driven backlight source to emit no light during the display period T for displaying a frame of image.

* * * * *